US006263713B1

(12) United States Patent
Fantl

(10) Patent No.: US 6,263,713 B1
(45) Date of Patent: Jul. 24, 2001

(54) SHEARABLE LOCK ASSEMBLY AND METHOD OF MANUFACTURE

(75) Inventor: Steven Albert Fantl, Colgate, WI (US)

(73) Assignee: Master Lock Company, Milwaukee, WI (US)

( * ) Notice: Subject to any disclaimer, the term of this patent is extended or adjusted under 35 U.S.C. 154(b) by 0 days.

(21) Appl. No.: 09/261,158

(22) Filed: Mar. 3, 1999

(51) Int. Cl.[7] ..... E05B 29/04

(52) U.S. Cl. ..... 70/492; 29/426.4; 29/434; 70/360; 70/375; 70/383; 70/422; 225/2; 225/93

(58) Field of Search ..... 70/358, 360, 361, 70/492, 493, 422, 375, 378, 392, 421, 382–385, 387, DIG. 75, 31, 50–52; 29/426.4, 434; 225/2, 93

(56) References Cited

U.S. PATENT DOCUMENTS

| | | | | |
|---|---|---|---|---|
| 1,295,351 | | 2/1919 | Morgan . | |
| 1,505,865 | | 8/1924 | Costa . | |
| 1,650,568 | | 11/1927 | Hurd . | |
| 1,789,757 | * | 1/1931 | Jacobi | 70/492 |
| 1,828,747 | | 10/1931 | Perry . | |
| 1,953,535 | | 4/1934 | Hurd . | |
| 1,958,603 | * | 5/1934 | Bacon | 70/493 X |
| 1,979,939 | | 11/1934 | Jacobi | 29/445 |
| 2,151,245 | * | 3/1939 | Swilens | 70/492 |
| 2,252,966 | | 8/1941 | Fogelson | 70/364 |
| 2,555,316 | | 6/1951 | Cerf, Jr. | 70/364 |
| 2,739,473 | * | 3/1956 | Quillen | 70/493 X |
| 2,820,360 | | 1/1958 | Soref et al. | 70/367 |
| 3,070,987 | | 1/1963 | Baker et al. | 70/383 |
| 3,073,146 | | 1/1963 | Patriquin | 70/383 |
| 3,078,705 | | 2/1963 | Morrison, Jr. | 70/383 |
| 3,125,878 | | 3/1964 | Gutman | 70/383 |
| 3,167,943 | | 2/1965 | Schreiber et al. | 70/358 |
| 3,175,378 | | 3/1965 | Russell | 70/382 |
| 3,234,768 | | 2/1966 | Russell et al. | 70/383 |
| 3,293,893 | | 12/1966 | Chesler | 70/385 |
| 3,563,071 | | 2/1971 | Barger | 70/383 |
| 4,103,526 | | 8/1978 | Surko, Jr. | 70/364 |
| 4,185,480 | * | 1/1980 | Pechner | 70/358 |
| 4,412,437 | | 11/1983 | Smith | 70/338 |
| 4,440,009 | | 4/1984 | Smith | 70/385 |
| 4,741,188 | | 5/1988 | Smith | 70/383 |
| 5,211,044 | | 5/1993 | Kim | 70/371 |
| 5,265,454 | * | 11/1993 | Crocco et al. | 70/492 X |
| 5,697,239 | | 12/1997 | Hanneman et al. | 70/493 |
| 5,735,153 | | 4/1998 | Hanneman et al. | 70/493 |

FOREIGN PATENT DOCUMENTS

| | | | | |
|---|---|---|---|---|
| 266379 | * | 10/1913 | (DE) | 70/493 |
| 2624320 | * | 1/1977 | (DE) | 70/493 |
| 1528882 | * | 12/1989 | (SU) | 70/493 |

* cited by examiner

*Primary Examiner*—Lloyd A. Gall
(74) *Attorney, Agent, or Firm*—Calfee Halter & Griswold LLP

(57) ABSTRACT

A lock and a method for manufacturing the lock. The lock comprises a shell having an interior cavity, a plug received in the interior cavity rotatably and axially slidably therein and defining a keyway configured to receive a preselected key, and a tumbler insertable in the plug. The tumbler has a plug portion disposed at a first axial location within the plug and resiliently biased outwardly toward a locked radial position and associated with the keyway such that the preselected key inserted in the keyway locates the tumbler in an unlock position and a shell portion disposed at a second axial location in the shell wherein the second axial location is axially spaced from the first axial location. The shell, the plug and the tumblers are configured such that the tumblers are sheared between the plug and the shell when the plug and the shell are forced axially toward each other.

25 Claims, 15 Drawing Sheets

SHEARABLE LOCK ASSEMBLY AND METHOD OF MANUFACTURE

BACKGROUND OF THE INVENTION

The present invention relates generally to cylinder locks having key operable tumblers. Cylinder locks have been widely used to secure doors and padlocks and in other applications. In certain applications, it is desirable that a single key fits a plurality of locks. For example in automotive applications, users may desire to have a single key that opens the doors, glove compartment and trunk that also operates the ignition. If one of the locks requires replacement at a later time, the replacement lock may require a new key for operation if the replacement lock is unable to be fitted to the original key.

U.S. Pat. No. 1,979,939 discloses a device and method for shearing projections of tumbler ends to fit a lock to a particular key. Spring loaded, wafer-like tumblers, having a length greater than the diameter of the plug of a lock, are inserted into the plug with the tumbler ends projecting axially beyond the plug. When a key is inserted in the keyway of the lock, the notches and cams on the blade of the key displace the tumblers and springs, projecting certain portions of the tumbler beyond the ends of the plug. A tool having two complementary cutters is used to shear the projected ends off the tumblers. When the key is removed and the plug is inserted in the shell, the springs are allowed to expand, forcing the tumblers to protrude into slots in the shell of the lock and preventing the rotation of the plug within the shell. As all of the tumblers are sheared together, a significant shearing force is required.

U.S. Pat. Nos. 5,697,239 and 5,735,153 disclose a method and apparatus for the manufacture of a pin tumbler cylinder lock with shearable assembly pins. The pins have a plurality of selectively weakened locations for an initial configuration of the lock corresponding to the shape of a notched key. The pins are biased radially into the plug of the lock by springs located in the lock shell. The pins can be sheared by the manufacturer or a locksmith, with the sheared portions of the pins functioning as the driver and the tumbler pins.

The disclosed methods and apparatus require the use of cutting tools or a significant shear force to fit the lock to a particular key. There is a need for a method of manufacture of a lock that provides greater case in keying or rekeying locks without comprising the security of the lock.

SUMMARY OF THE INVENTION

The present invention is related to a lock having a shell, a plug mounted in the shell and a plurality of tumblers that extend into the shell. The tumblers have a plurality of grooves notched on both ends such that when a key is inserted in the lock, the key lifts the tumblers according to the notches on the key, aligning the grooves on the tumblers. The shell and plug are forced axially toward each other shearing the tumblers along the aligned grooves to fit the lock to the key. The present invention is further directed to a shell and plug configuration that reduces the total shearing force required for shearing the tumblers and to a method of manufacturing a lock having shearable tumblers for a preselected key.

DESCRIPTION OF THE PREFERRED EMBODIMENT

Figure 1:
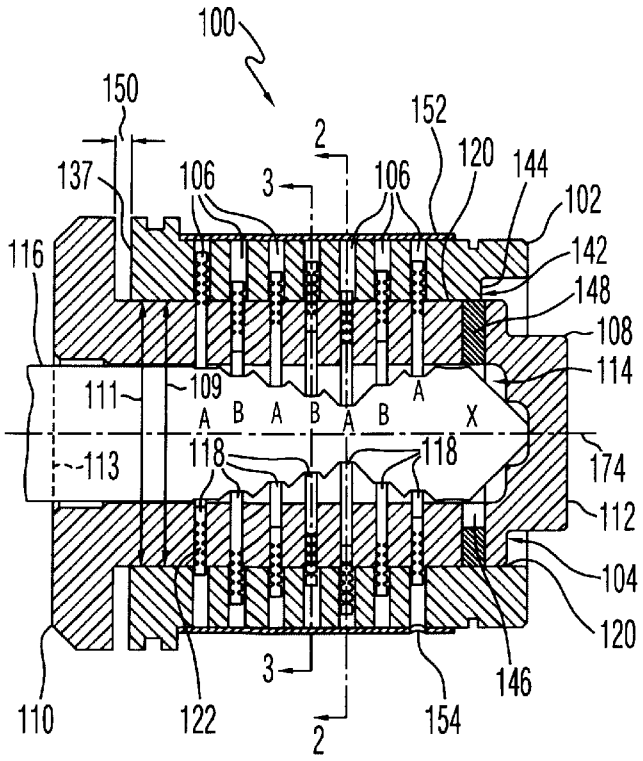
FIG. 1 is a cross-sectional view of the lock constructed according to the present invention prior to the shearing of the tumblers.

Referring now to FIG. 1, lock 100, as shown in a loading position, comprises a substantially cylindrical shell 102 having a shell interior cavity 104. Shell 100 has seven shell passageways 106 extending radially between the exterior of the shell 102 and the shell interior cavity 104. The shell 102 is preferably made of zinc, brass, plastic or other suitable materials.

A turnable cylindrical plug 108 is axially mountable for rotatable movement within the shell interior cavity 104 of the shell 102. The plug 108 has a plug collar 110 located at one end of the plug 108 and a plug tail 112 disposed axially from the plug collar 110 on the other end of the plug 108. The plug tail 112 is connectable to a latch that drives a bolt or other locking devices to lock or open a door or other movable member as disclosed in the art. The plug 108 has a keyhole 113 leading to a keyway 114 configured for receiving the blade 128 of a key 116. Plug 108 has seven plug passageways 118 extending radially from the keyway 114 through the plug 108 and opening into the shell 102. The plug 108 has an outer diameter 109 that is less than the inner diameter 111 of the interior cavity 104 of the shell 102, creating a shearing zone 120 between the shell 102 and the plug 108. In the loading position of the lock as shown in FIG. 1, plug passageways 118 extend across the keyway 114 and are initially aligned with shell passageways 106 for receiving shearable, wafer-like, tumblers 122. The plug 108 is preferably made of a zinc, brass, plastic or other suitable materials.

FIG. 1 shows the preferred embodiment according to the present invention in a loading position in which the tumblers 122 are loaded in the plug and shell passageways 118 and 106 respectively of the plug 108 and shell 102 before being sheared therebetween. In FIG. 1, the shell 102 and the plug collar 110 define a gap 150 for allowing axial movement of the plug 108 relative to the shell 102 along the shearing zone 120. The dimension of the gap 150 is selected to allow sufficient penetration of the plug 108 into the shell 102 when shearing the tumblers 122. Preferably the gap is between 0.04 inches and 0.06 inches, and most preferably, the gap is about 0.05 inches.

A tubular retention sleeve 152 is manufactured to fit over the exterior of the shell 102 and is securable to the shell 102 by a retention sleeve crimp 154 engaging the exterior of the shell 102, as shown in FIG. 1. Preferably the retention sleeve crimp 154 is in one of the shell passageways 106, but the sleeve may alternatively engage with another recessed portion of the shell 102. Referring to FIGS. 2, 3, 9 and 10, the retention sleeve 152 has a set of first slots 156 and a set of second slots 158 extending therethrough that are alignable with the shell and plug passageways 106 and 118. Preferably the first set of slots 156 and the second set of slots 158 are interposed axially in sequence and are angularly displaced from each other around the sleeve by a sleeve displacement angle 160. Angularly displacing slots 156 and 158 allows the insertion of the tumblers 122 into the plug and shell passageways 106 and 118 in two groups such that the tumblers 122 are radially and resiliently biased from the plug in radially opposite directions, as described in greater details hereinafter. The slots 156 and 158 have a rectangular portion 159 shaped to receive the tumblers 122 and a circular portion 161 shaped to receive the springs 178. Sleeve angle 160 is measured from the center of the rectangular portion 159 of the sleeve slot 156 to the center of the rectangular portion 159 of the sleeve slot 158. Preferably, sleeve angle 160 is less than 180° such that the one set of slots 156 and 158 allows the insertion of the tumblers 122 into alternative plug and shell passageways 106 and 118 while the other passageways are closed by the sleeve 152. Most preferably, sleeve angle 160 is about 135°. Preferably, the sleeve angle 160 is between 5° and 180°, or more preferably 90° to 150°.

Figure 2:
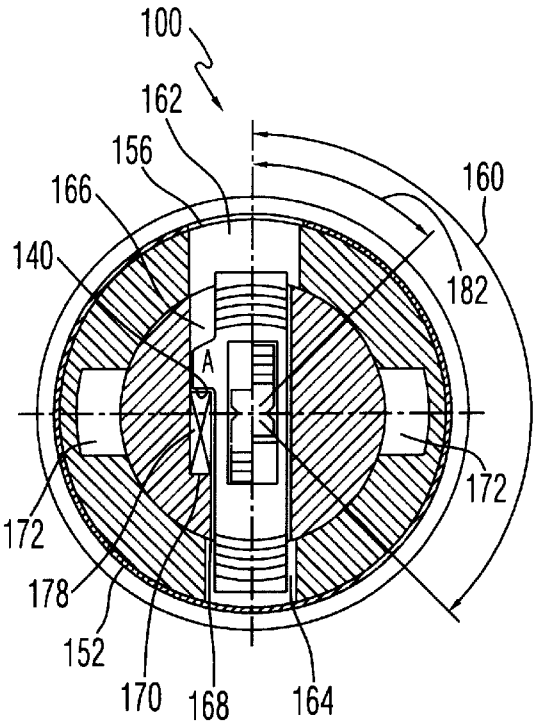
FIG. 2 is a cross-sectional view of the lock in FIG. 1 along lines 2—2.
Figure 3:
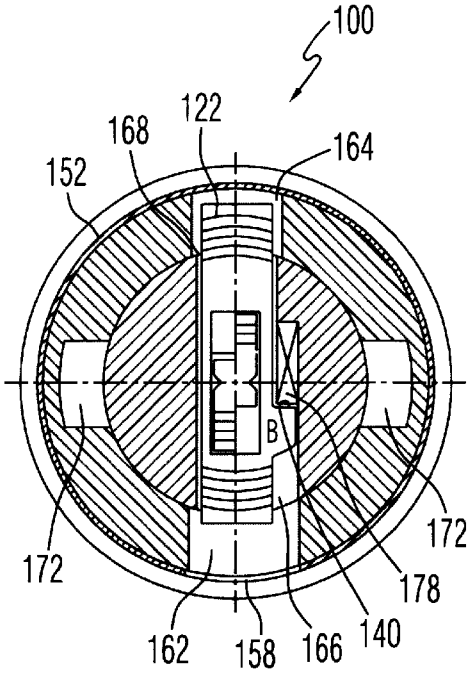
FIG. 3 is a cross-sectional view of the lock in FIG. 1 along lines 3—3.

Referring to FIGS. 2 and 3, the lock is shown in the loading position with the shell passageways 106 and plug passageways 118 aligned, and shearable tumblers 122 extending radially from one side of the plug 108 to the other and into the shell passageways 106. Each shell passageway 106 has a first shell opening 162 that is preferably wider than a second shell opening 164. Similarly, each plug passageway 118 has a first plug opening 166 that is wider than a second plug opening 168. The first plug opening 166 meets the second opening 168 forming a spring seat 170 within the plug 108.

In FIG. 2, the sleeve 152 openings 156 are aligned with alternate shell and plug passageways 106 and 118 marked as A for loading with tumblers 122. In FIG. 3, on the other hand, sleeve 152 has been rotated to align openings 158 with alternate plug and shell passageways B for loading tumblers 122.

Keys adaptable for cylinder locks are either one or two sided, i.e., having notches on one side or both sides of the blade of the key, respectively. A one-sided key usually has about five notch locations with about eight different depths of cuts associated with each notch location. In contrast, a two-sided key is notched on both sides and may use as many as ten notch locations with about five different cut depths associated with each notch location. An example of a use for a two-sided key is in automotive cylinder locks. The two-sided key, having greater number of notch locations, can accommodate the various applications associated with the car, such as the ignition, doors, trunk, and glove compartment. In addition, automotive cylinder locks provide multiple levels of security through the use of secondary keys that only allow access to selected applications, such as the valet key. Moreover, a lock cylinder for use with two-sided keys allows removal of the key from the cylinder in either locked or unlocked positions.

Figure 4:
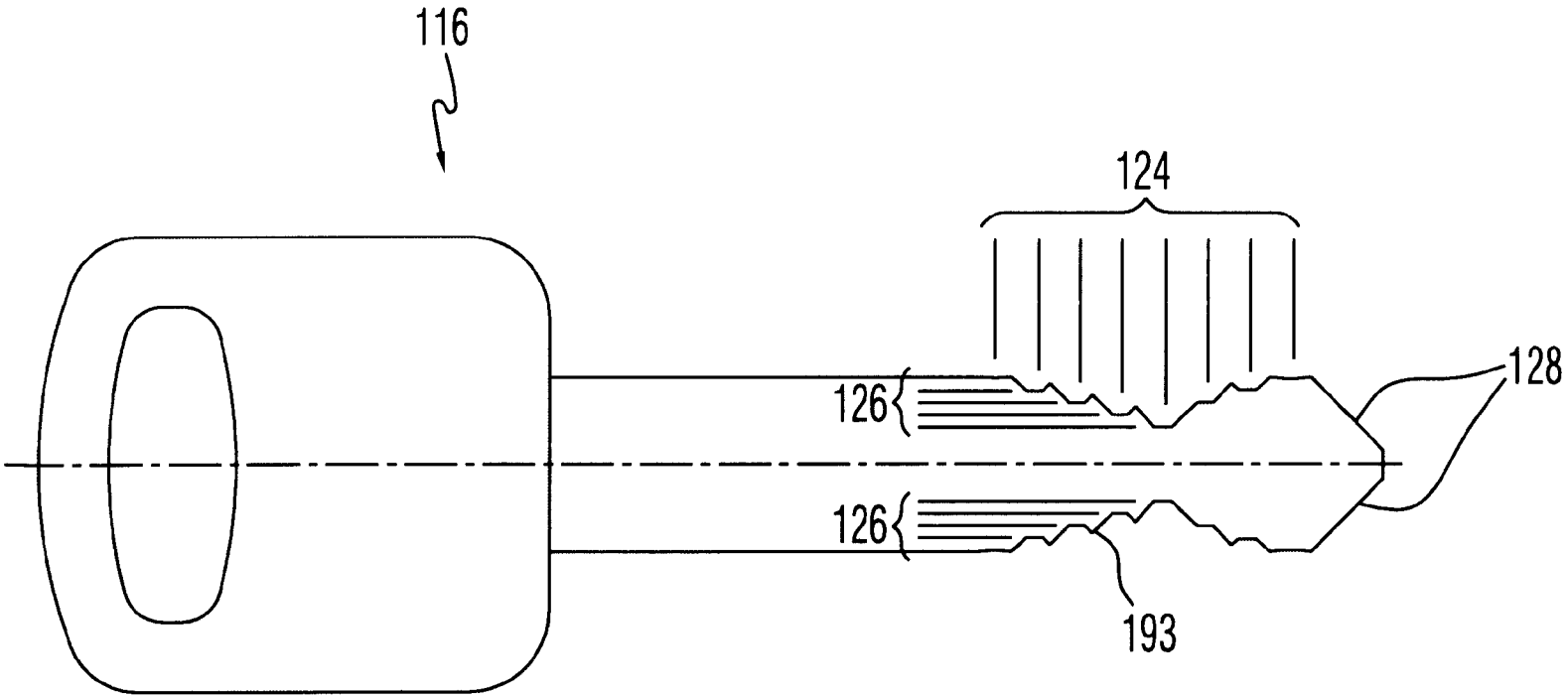
FIG. 4 is a side view of a two-sided notched key.

A key 116, adaptable for use with the present invention, is shown in FIG. 4 as having a plurality of notch locations 124 with each having various different cut depths 126 on opposite edges of the blade 128 of the key 116. Key 116, has ten notch locations 124 and five different cut depths 126 on opposite edges of the blade 128 of the key 116, creating 9,765,623 usable keying combinations.

Figure 5:
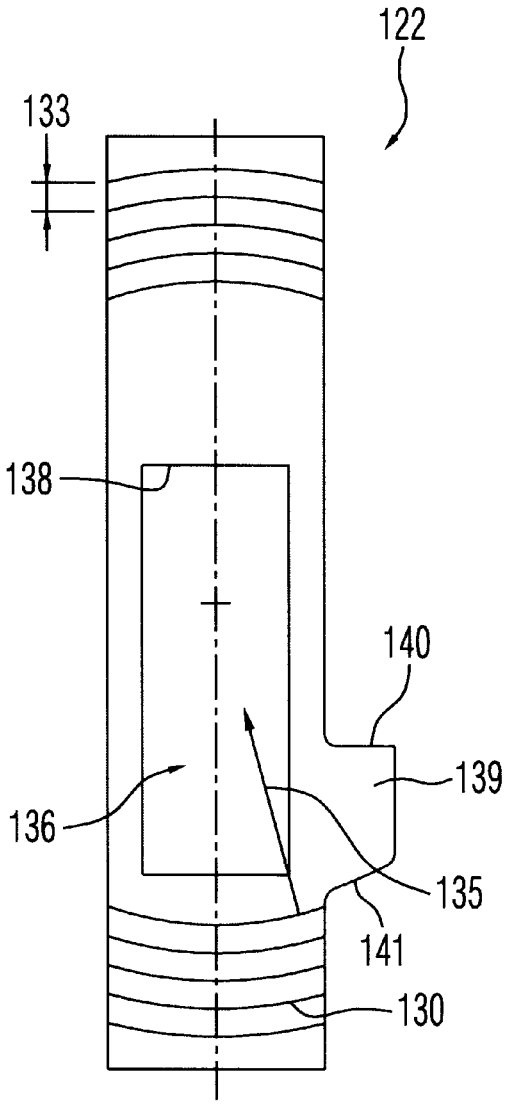
FIG. 5 is a front view of a tumbler of an embodiment of the present invention.
Figure 6:
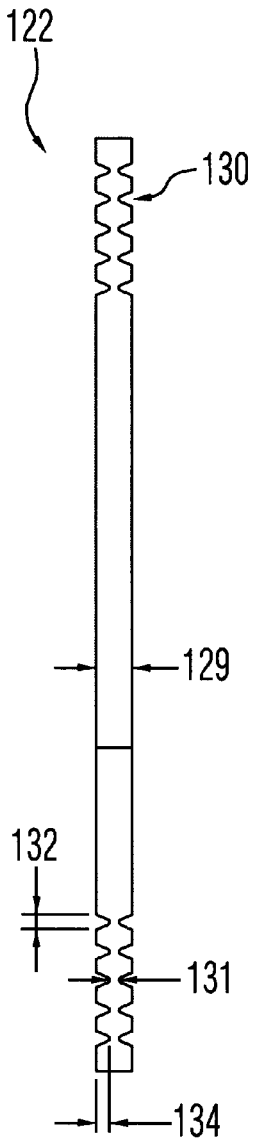
FIG. 6 is a side view of the tumbler of FIG. 5.

Each tumbler 122 has a key blade abutting portion 138 located in a center opening 136, as shown in FIG. 5. The opening 136 is cut out from the tumbler 122 and is shaped to receive the blade 128 of the key to interface with the key notches 124. Finally, each tumbler 122 has a protuberance 139 protruding laterally therefrom to define a ledge 140 and an outer tumbler seat 141. The tumblers 122 are made of a suitable material, such as brass. Multiple grooves 130 are preferably coined or stamped on the surface of the tumblers 122, as shown in FIGS. 5 and 6. Each tumbler 122 is wafer shaped and has a thickness 129 and five weakened zones defined by notches or grooves 130 on each side of the tumbler to facilitate and localize their shearing. Also, the grooves are arcuate in this embodiment with a shape corresponding to the shape of the shearing zone 120 defined between the plug and the shells. The groove widths 132 and depths 134 are selected to reduce the axial shear force necessary for shearing the tumblers 122 when configuring the lock with a preselected key. During this configuring operation, an axial shearing force is applied to shear the tumblers 122 by axially shifting the plug 108 and shell 102 relative to each other.

The grooves 130 have a radius of curvature 135, preferably between the radius of the interior cavity 104 and the outer radius of the plug 108. Each of the grooves 130 has a groove width 132, preferably ranging from about 0.0060–0.010 inches. The grooves are spaced at a radial distance 133 from each other. The radial distance 133 preferably corresponds to the distance between the available notch depths 126 at each notch location of the key 116. Preferably, the radial distance 133 is between about 0.015–0.030 inches. Most preferably, the radial distance 133 is about 0.025 inches. However, distance 133 can be modified to accommodate different keying systems. The grooves have a depth 134, as shown in FIG. 6, and the preferred groove depth 134 is about 0.012 inches. The series of grooves 130 is positioned on the tumblers 122 such that the grooves 130 are alignable with the shearing zone 120 between the shell 102 and the plug 108 by preselected keys with the appropriate combination of notch locations 124 and cut depths 126, as shown in FIGS. 1–3. The number and placement of the grooves 130 preferably correspond to the available cut depths 126 of the key notches 124, although additional grooves 130 can be employed.

The tumblers 122 have a relative torque strength which corresponds to the amount of rotative torque the tumbler 122 can resist when the plug 108 is forced rotationally in the shell 102 with the tumblers 122 in the locked position against the walls of the passageways. It is desirable to maximize the rotative torque strength of the tumblers 122 while minimizing the axial shearing force required for shearing the tumblers 122 in manufacturing a lock. Accordingly, the tumbler groove 130 portions of the tumblers 122 arc not so weakened such that another insertable key, one having the same keyway configuration as the preselected key but with a different notch cut, could be torqued by hand or by a tool to further shear the tumblers 122 prior to key or tool failure. In other words, the weakest part of the grooves 130, or the center 131, is preferably strong enough to resist a torque force to the tumblers 122 equal to the maximum rotative force that can be applied through the keyhole 113 by any key or key-like tool that can be inserted into the keyhole 113. This minimizes compromise in security while the lock is in service.

Figure 7:
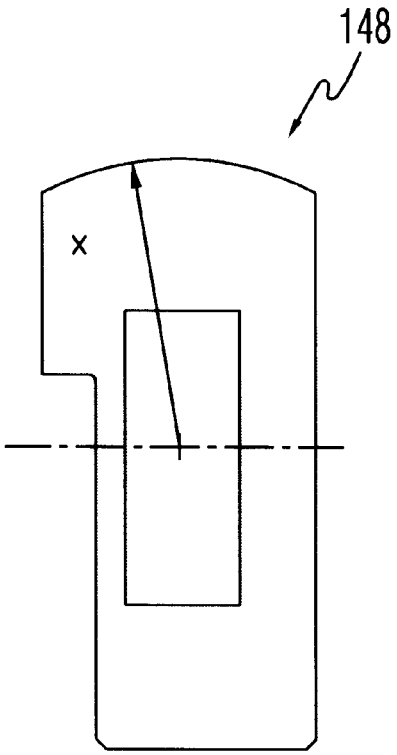
FIG. 7 is a front view of a retention tumbler of an embodiment of the present invention.
Figure 8:
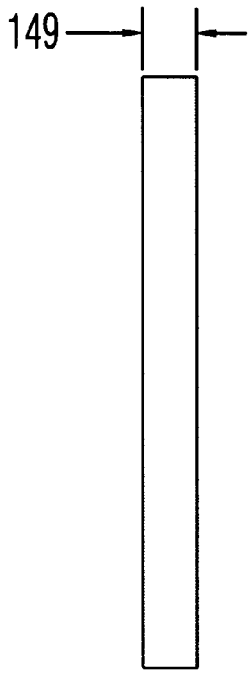
FIG. 8 is a side view of the retention tumbler of FIG. 7.
Figure 10:
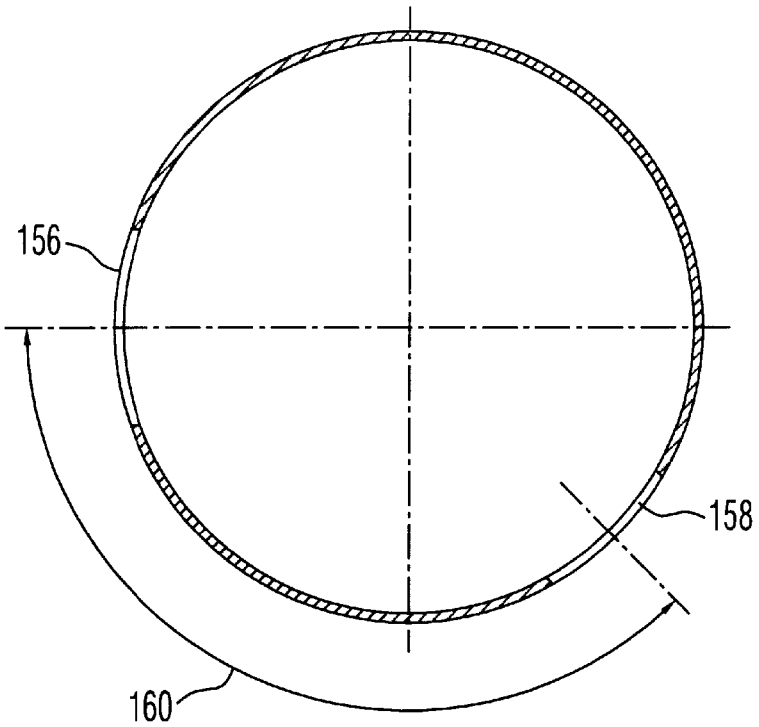
FIG. 10 is a cross-sectional view of the retention sleeve in FIG. 9 along plane 10—10.
Figure 9:
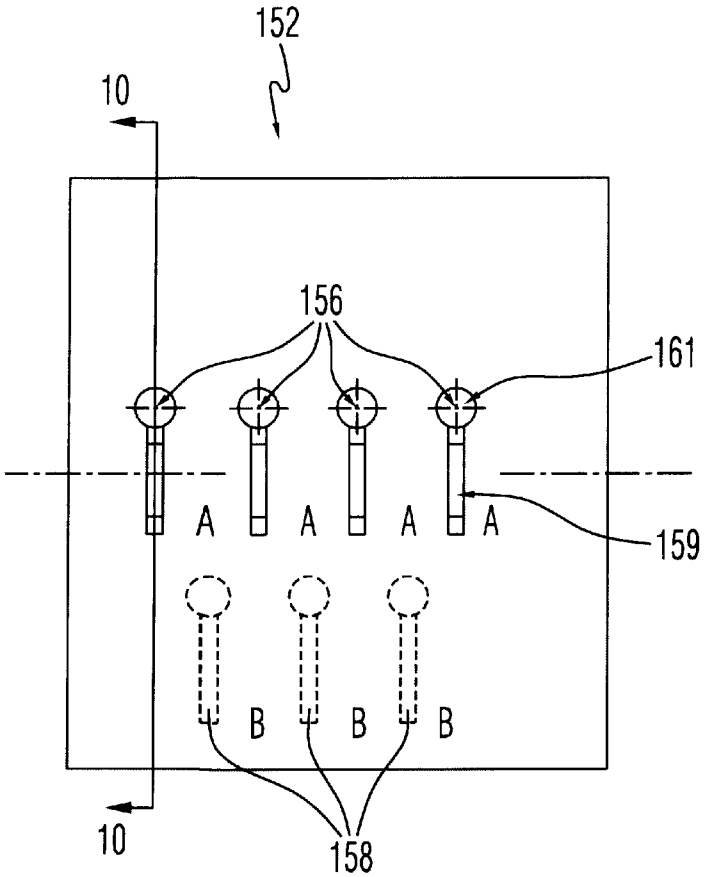
FIG. 9 is a top view of a retention sleeve constructed according to the present invention.
Figure 15:
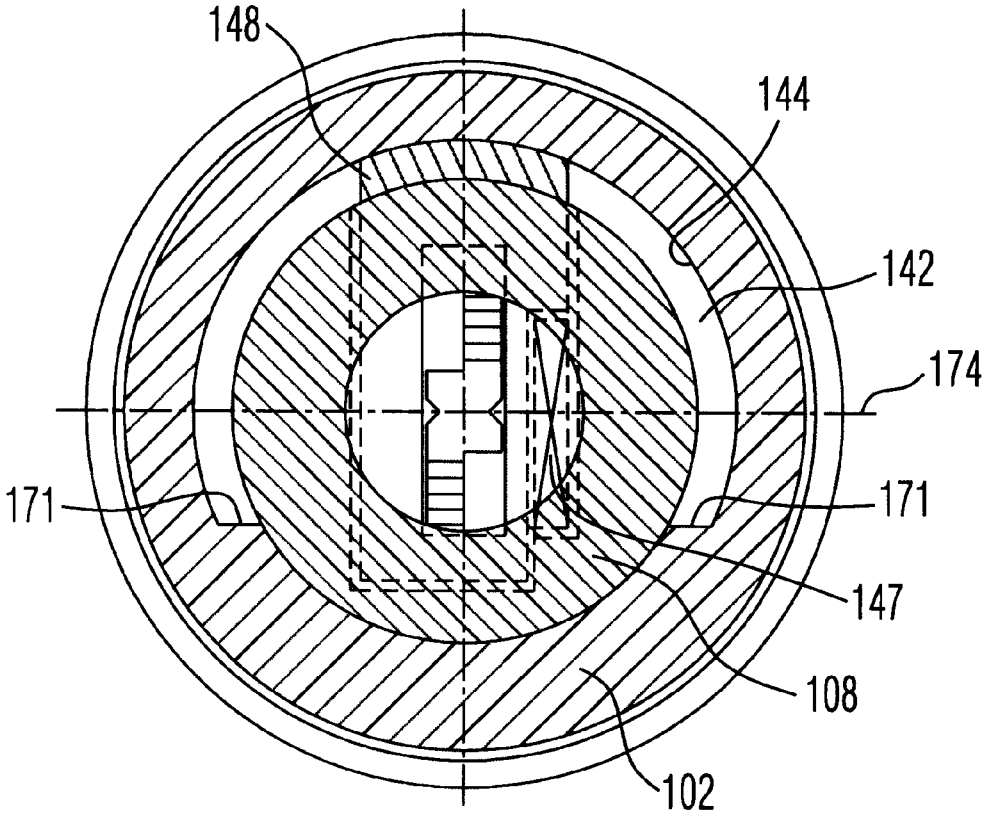
FIG. 15 is a cross-sectional view of the lock in FIG. 12 along line 15—15.

Referring to FIGS. 1–3 and 15, the shell 102 defines a retention groove 142 with a rearwardly facing retention wall 144 adjacent to the interior cavity 104. The retention groove 142 circumferentially abuts the interior cavity forming stops 171 at either end of the groove, best shown in FIG. 15. The plug 108 defines a retention slot 146 extending radially from the keyway 114 into the plug 108 and opens into the interior cavity 104. A retention tumbler 148, as shown in FIGS. 7 and 8, and a retention spring 147, as shown in FIG. 15, are insertable within the retention slot 146. In FIG. 1, the retention tumbler 148 is in an inactive position and out of engagement with the retention groove 142 of the shell 102. When moved to its active position upon axial shifting of the plug 104 toward the shell 102 from the loading position of FIG. 1 to the operative position of FIG. 12, the retention tumbler 148 is axially biased by the spring 147 within the plug 108 to extend outwardly toward the shell retention groove 142 and is allowed to rotate freely against the retention wall 144. In this position, the retention tumbler 148 prevents the extraction of the plug 104 from the shell 102.

The retention tumbler 148 preferably has a greater thickness 149 and a greater strength than the shearable tumblers 122. Instead of a separate retention tumbler 148, a plurality of retention grooves 142 may be disposed in the shell passageways 106 to engage the outwardly biased tumblers 122 for retaining the plug 108 within the interior cavity 104.

Figure 12:
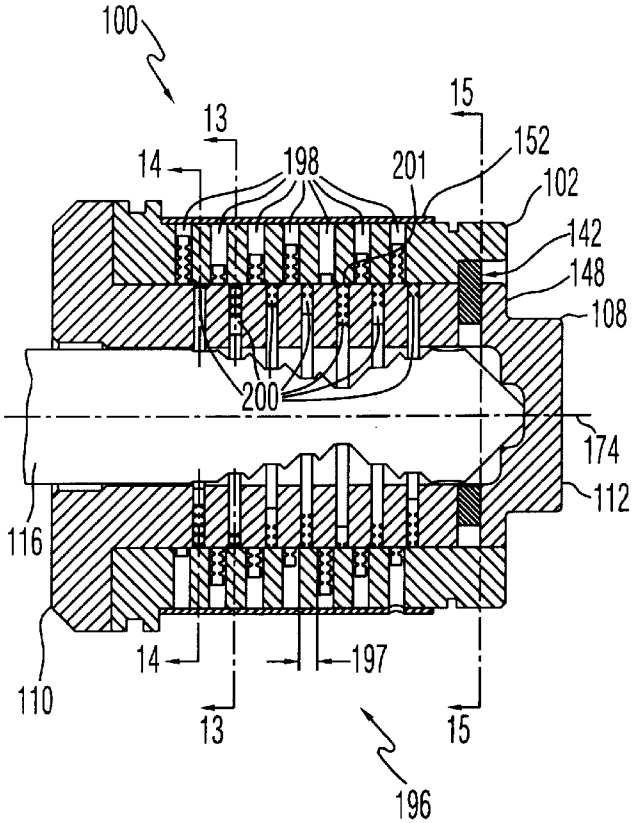
FIG. 12 is a cross-sectional view similar to the lock in FIG. 1 in which the tumblers have been sheared by relative axial movement between the shell and the plug.
Figure 17:
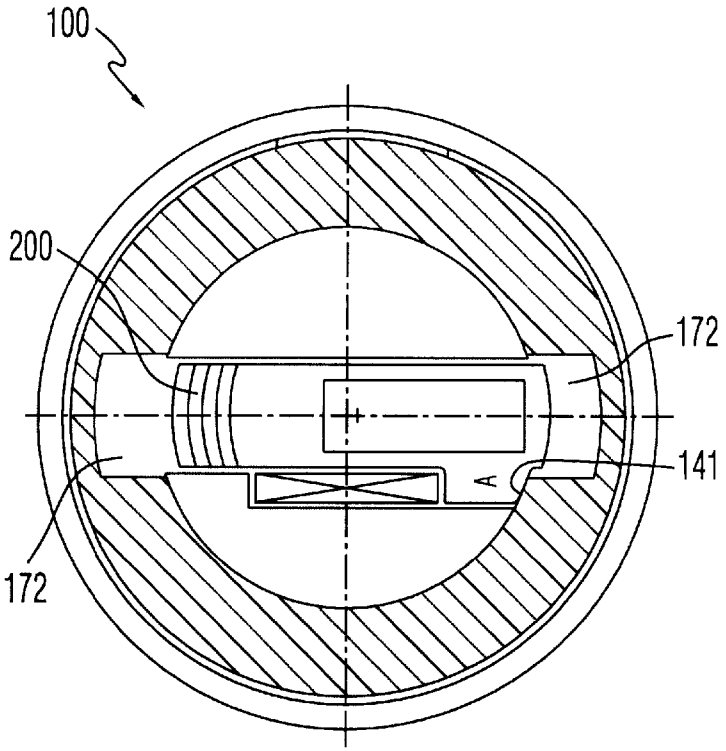
FIG. 17 is the lock in FIG. 16 in the locked position.
Figure 16:
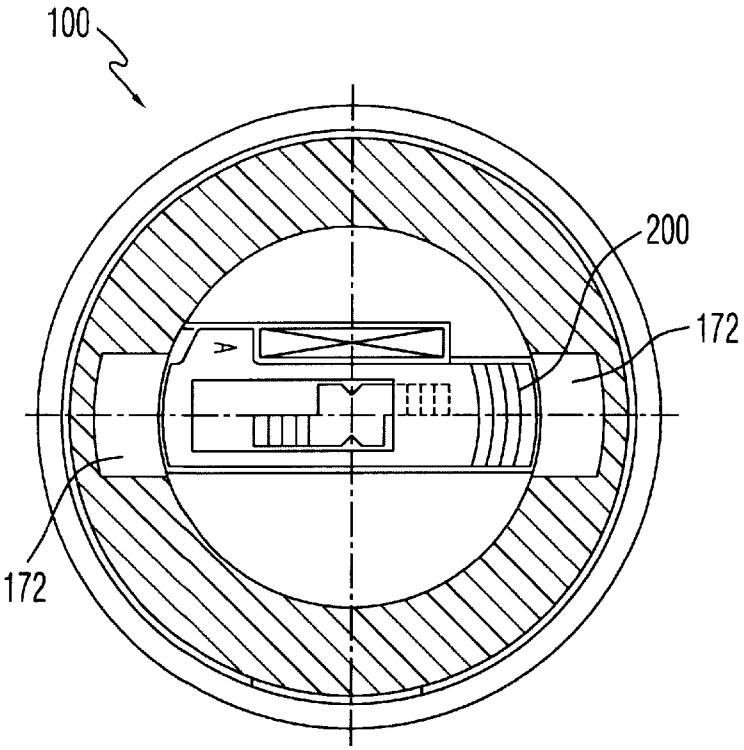
FIG. 16 is a cross-sectional view of FIG. 14 in an unlocked position.

The shell 102 further defines shell locking channels 172, shown in FIGS. 16 and 17, that extend radially from the interior cavity 104 of the shell 102 for receiving the tumblers 122 when the lock 100 is in its operative position of FIG. 12. Locking channels 172 engages the plug portions 200 of the tumblers 122 to prevent rotation of the plug 108 in the interior cavity 104 of the shell 102. The locking channels 172 are shown as diametrically opposed, or located at 180°, with respect to each other. In this arrangement, the plug 108 can be rotated 180° between the lock and unlock positions so that the key 116 may be removed. However, locking channels 172 may be disposed in the shell at an angle less than 180° with respect to each other, where less rotation of the plug 108 in the interior cavity 104 is desired. In addition, the shell may comprise only one locking channel 172, which will allow the key 116 to be removed from the lock 100 only when it is in the locked position. This is desirable for high security uses where the lock is to remain locked unless an intended user is present with the key 116.

Figure 11:
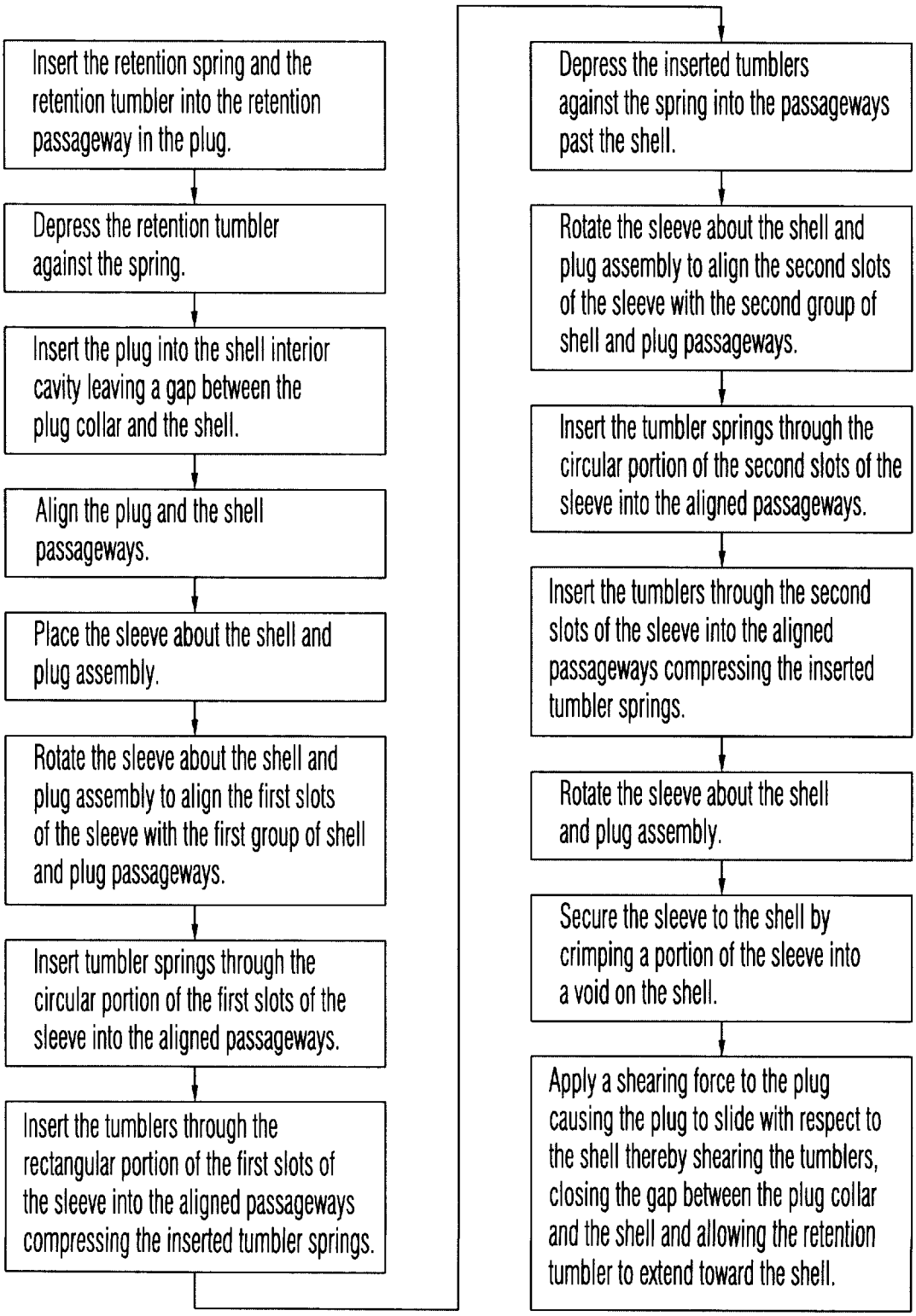
FIG. 11 is a flowchart showing the steps of assembling the lock according to the present invention

In the assembly of the lock 100, as described in the flow chart in FIG. 11, the retention tumbler 148 and retention spring 147 are inserted into retention slot 146, at axial location X in FIG. 1, of plug 108. The retention tumbler 148 is depressed against the retention spring 147 when the plug 108 is inserted within the interior cavity 104 of the shell 102 and remains depressed within the plug 108 by the inner wall of the shell inner cavity 104 during the loading of the tumblers 122. The plug 108 is thereafter inserted into the interior cavity 104 of the shell 102 along a center axis 174 such that the shell passageways 106 and plug passageways 118 are aligned, and the gap 150 is created between the shell 102 and the collar 110 of the plug 108. The shell passageways 106 are aligned with plug passageways 118 such that the first shell openings 162 are aligned with first plug opening 166 and the second shell opening 164 are aligned with second plug opening 168 at axial locations A, as shown in FIGS. 2 and 3.

Retention sleeve 152 is placed around the shell 102 in a first loading position in which the first slots 156 are aligned with first shell openings 162 and first plug openings 166 at location A and the second shell openings 164 and second plug openings 168 are covered. The first loading position exposes alternating shell passageways 106 and plug passageways 118 at axial locations A in FIG. 1. Springs 178 are inserted into the exposed shell and plug passageways 106 and 118 through circular portions 161 of the first slots 156 with the springs 178 abutting the spring seats 170, as shown in FIG. 2. Tumblers 122 are then inserted into the exposed shell and plug passageways 106 and 118 through the rectangular portions 159 of the first slots 156 such that springs 178 are held between ledges 140 of the tumblers 122 and the spring seats 170, for biasing the tumblers 122 radially outward from the plug 108 toward the shell 102.

The retention sleeve 152 is then rotated about the center axis 174 by an angle 182 to a second loading position. In the second loading position, second slots 158 of the retention sleeve 152 are aligned with the remaining shell and plug passageways 106 and 118, at locations B in FIG. 1. In the second loading position, the sleeve 152 closes off the shell and plug passageways 106 and 118 at locations A. The rotational angle 182 is correlated to sleeve angle 160 such that rotating the sleeve 152 with the first slots 156 aligned with shell and plug passageways 106 and 118 at axial locations A about the center axis 174 by rotational angle 182 aligns the second slots 158 with shell and plug passageways 106 and 118, as shown in FIG. 2. Springs 178 and tumblers 122 are disposed within the exposed shell and plug passageways 106 and 118 at location B with springs 178 held between ledges 140 and spring seats 170, for biasing the tumblers 122 radially outwardly from the plug 108 toward the shell 102 in a direction opposite the tumblers 122 at location A, as shown in FIG. 3. FIG. 1 shows the lock 100 in its loading position and FIGS. 2 and 3 show the tumblers 122 in a pre-shearing position. The tumblers 122 in the shell and plug passageways 106 and 118 in the first locations A are interposed axially with tumblers 122 in the second locations B such that the tumblers are resiliently biased upwardly and downwardly by the springs 178 in a sequentially alternating fashion along the direction of the axis 174.

The retention sleeve 152 is rotated a second rotational angle 190, preferably about 45°, about the center axis 174 to a closed position in which both the slots 156 and 158 are out of alignment with all shell and plug passageways 106 and 118. The retention sleeve 152 is then secured by the retention sleeve crimp 154 on the exterior of the shell 102 by crimping a portion of the sleeve material therein for retaining the tumblers 122 in the shell 102, as shown in FIG. 1, or in one of the shell passageways 106, as shown in FIG. 12. In the closed position, the retention sleeve 152 closes off the shell passageways 106 from the exterior of the lock 100.

In this loaded position, the lock is now ready to be fitted to the preselected key 116. A key adaptable for use with the present invention is the two-sided key 116, as shown in FIG. 4. Key 116 is inserted within the keyway 114 of the lock 100 through key hole 113. The sloped positions 193, shown in FIG. 4, of the key blade 128 cam the tumblers 122, through abutment with the upper edges 138 of the tumbler openings 136 in contact with the notches 124. The tumblers 122 are resiliently biased in opposite directions against the key 116 by the springs 178. The insertion of the key 116 retracts the tumblers 122 inwardly into the plug 108 to an unlocked position in which certain grooves 130 are aligned along the shearing zone 120. Shell 102 and the plug 108 are then forced axially toward each other along the center axis 174 to complete the assembly of the lock 100 into the operative operation, as shown in FIG. 12. As the plug 108 is forced toward the shell 102, tumblers 122 are sheared along the aligned grooves 130, and the gap 150 between the shell 102 and plug collar 110 is closed. The size of gap 150 is selected such that penetration of the plug 108 into the shell 102 is halted at the assembled operative position shown in FIG. 12, when the collar 110 contacts the proximal or front side 137 of the shell 102. In the operative position, as shown in FIG. 12, the axial travel of the plug 108 into the shell 102 is restricted such that the shell passageways 106 are no longer aligned with plug passageways 118. Forcing the plug 108 into the shell 102 completely shears the tumblers 122 into releasable or shell portions 198 and plug portions 200. The shell portions 198 remain in the shell passageways 106 inside the retention sleeve 152, and the plug portions 200 remain in the plug passageways 118.

Figure 14:
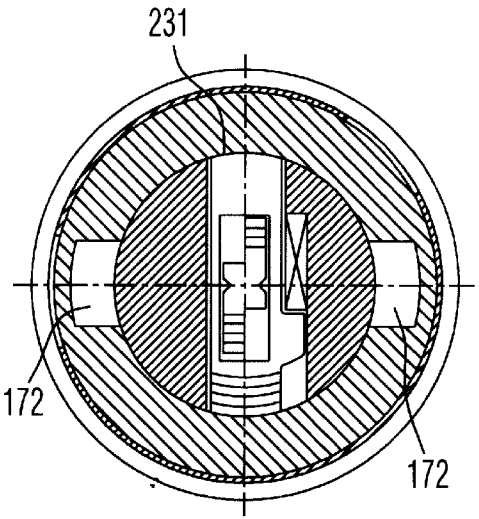
FIG. 14 is a cross-sectional view of the lock in FIG. 12 along plane 14—14.
Figure 13:
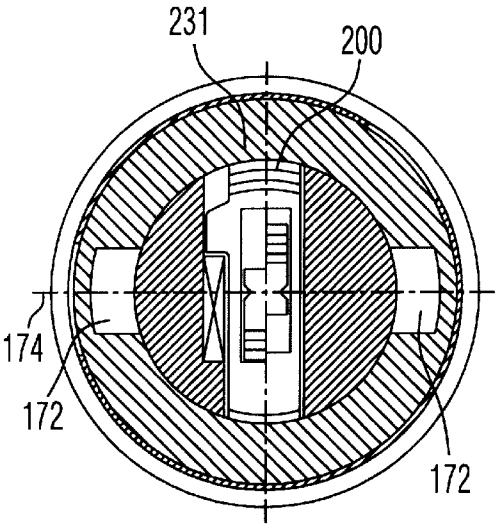
FIG. 13 is a cross-sectional view of the lock in FIG. 12 along plane 13—13.

In the operative position of FIG. 12, the plug portions 200 of the tumblers 122 are out of alignment with the shell passageways 106 by a distance 197, which is preferably greater than the thickness 129 of the tumblers 122. Accordingly, when the plug 108 is rotated within the interior cavity 104, the plug portions 200 of the tumblers 122 abut the interior cavity wall 231 between the passageways 106 preventing the tumblers 122 from catching the shell passageways 106 when the plug 108 is rotated within the interior cavity 114, as shown in FIGS. 13 and 14. Preferably, the distance 197 is between 0.036 and 0.076 inches. Most preferably, the distance 197 is 0.056 inches.

As explained above, once the lock 100 is in the operative position, the retention tumbler 148 is biased radially outward into the retention groove 142 abutting the retention wall 144 to prevent extraction of the plug 108 from the shell 102, as shown in FIG. 15. The retention tumbler 148 is extended into the retention groove 142, and the plug 108 is rotatable within the shell 102 with the retention tumbler 148 abutting the retention groove 142 preferably in contact with the retention wall 144. Since the rotation of the retention tumbler 148 is restricted about the center axis 174 when the retention tumbler contacts either one of the two stops 171, the rotation of the plug 108 within the interior cavity 104 is likewise restricted. Preferably the stops 171 in the retention groove 142 sufficiently restrict the rotation of the plug 108 within the interior cavity 104 such that the plug portion 200 is retained in an unlocked position by the interior cavity wall 231 of the interior cavity 104 and allow the lock 100 to rotate from the locked position to the unlock position, as described below with reference to the locking channels 172. Preferably, the retention tumbler 148 and the retention groove 142 allow at least 90° of rotation of the plug 108 with respect to the shell 102, and most preferably up to about 270°.

Referring to FIG. 16, when the lock is in use and the key 116 is inserted within the keyway of the lock 100 in the locked position, the notches 124 of the key 114 depresses the spring 178 to shift the plug portions 200 out of the locking channel 172, shown at the left side of FIG. 16. While the key 116 remains in keyway 114, the plug 108 can rotate within the interior cavity 104 of the shell 102, and at this state, the lock 100 is still unlocked. Once the key 116 is removed, as shown in FIG. 17, the spring 178 is relaxed thereby radially extending the plug portion 200 into the oppositely disposed locking channel 172 until the tumbler seats 141 abut the interior wall 231, preventing rotation of plug 108 within the interior cavity 104 of the shell 102, and at this state, the lock 100 is unlocked.

Once the lock 100 is in the operative position, the shell 102, containing the tumbler shell portions 198 within the shell passageways 106, and the sleeve 152 can be removed and replaced with another shell having only locking channels 172 without interfering with the operation of lock 100. The removed shell maybe reused for fitting another key and plug. In order to replace the shell 102 with one having only locking channels 172, the retention tumbler 148 can be pushed inwardly from the retention groove 142, depressing the retention spring 147 and thus allowing extraction of the plug, 108 from the internal cavity 104 of the shell 102. During extraction, the tumbler shell portions 198 will fall out of the shell passageways 106. The retention sleeve 152 may then be removed, and the shell 102 can be reassembled with new tumblers 122. Preferably, however the shell 102 and sleeve 152 are left in place.

Figure 18:
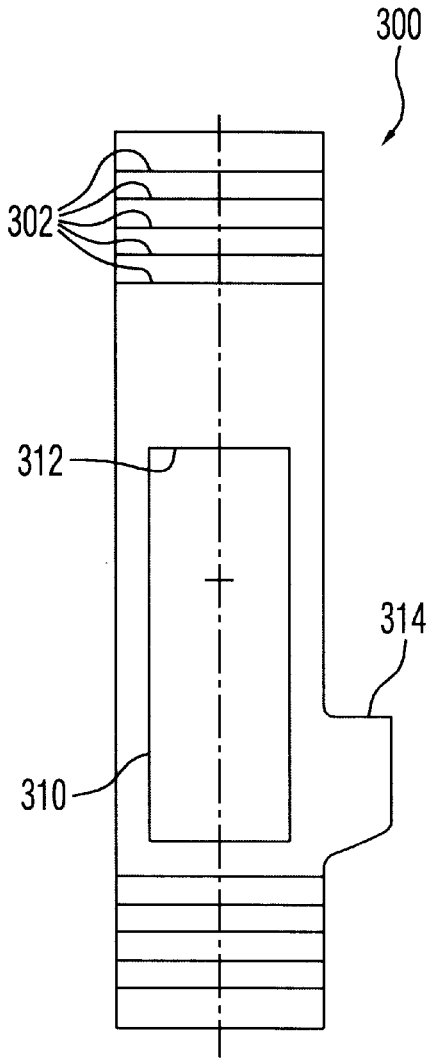
FIG. 18 is a front view of a tumbler of another embodiment.
Figure 19:
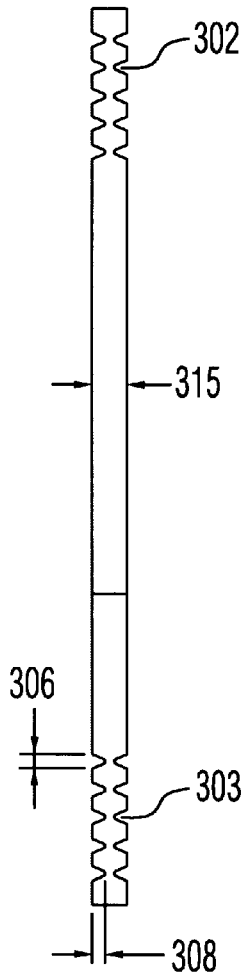
FIG. 19 is a side view of the tumbler in FIG. 18.
Figure 21:
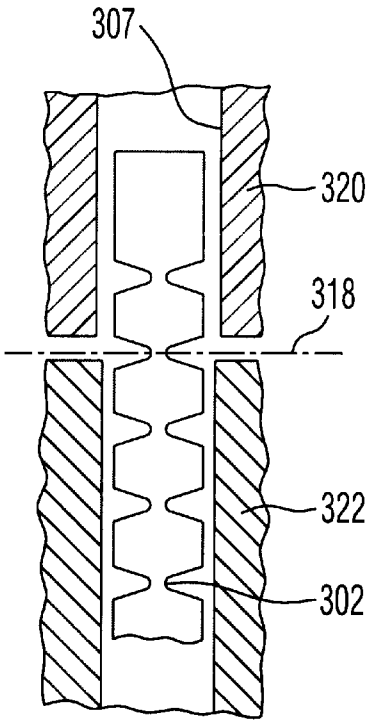
FIG. 21 is a side view of the lock of FIG. 20.
Figure 20:
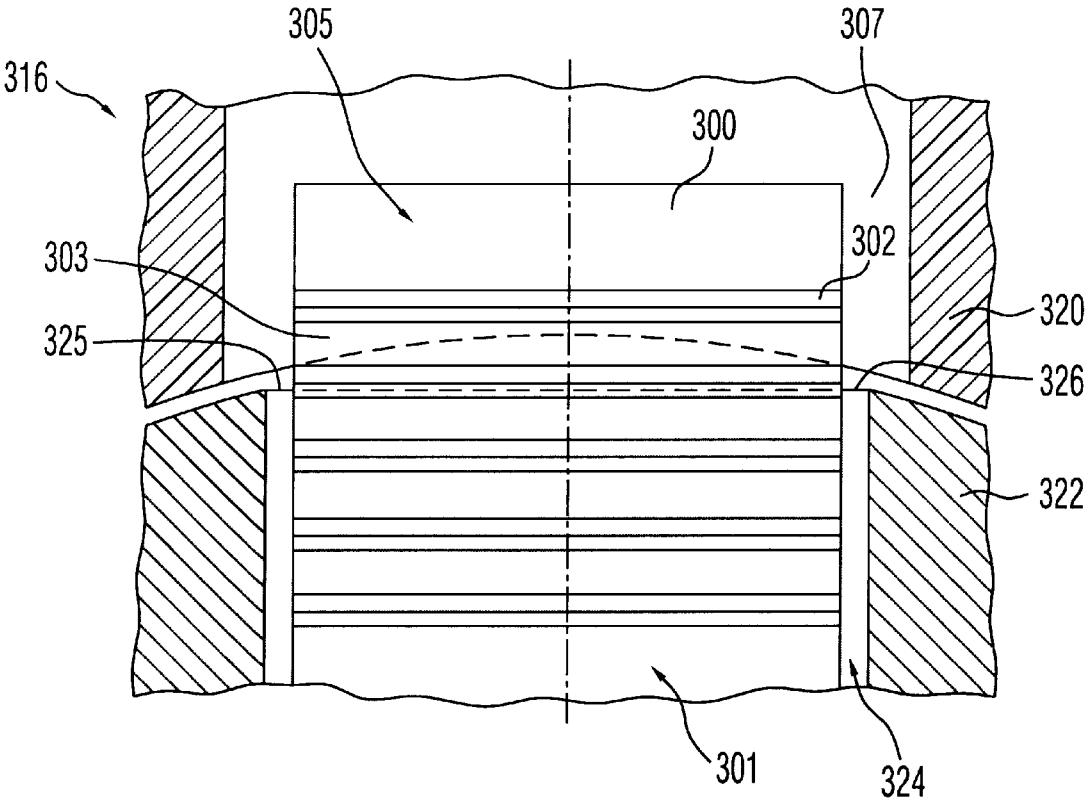
FIG. 20 is an enlarged cross-sectional end view of an embodiment of the present invention with the tumbler of FIG. 18.

FIGS. 18 and 19, show a modified embodiment of the tumbler. Here, tumbler 300 has straight grooves 302 disposed on opposite ends of the tumbler 300, forming weakened zones to facilitate and localize the shearing of the tumblers 300. The multiple grooves 302 are preferably coined or stamped on the surface of the tumblers 300. The entire tumbler 300 is preferably coined or stamped from a sheet of material in a single operation. The groove widths 306 and depths 308 are selected to reduce the shear force necessary for shearing the tumblers 300 while preserving sufficient strength in the unsheared groove portion of the tumblers 300, as shown in FIG. 19. Preferably, the bases 303 of the grooves 302 are sharp or have a small radius of about 0.002 inches. As shown in FIGS. 20 and 21, tumblers 300 are insertable into a lock 316 having a shearing zone 318 formed between shell 320 and plug 322. The series of grooves 302 is positioned on the tumblers 300 such that the grooves 302 are alignable with the shearing zone 318 by a preselected key 116. Preferably the plug 322 has plug passageways 324 with laterally straight edges 326 across the opening of the plug passageways 324.

Figure 22:
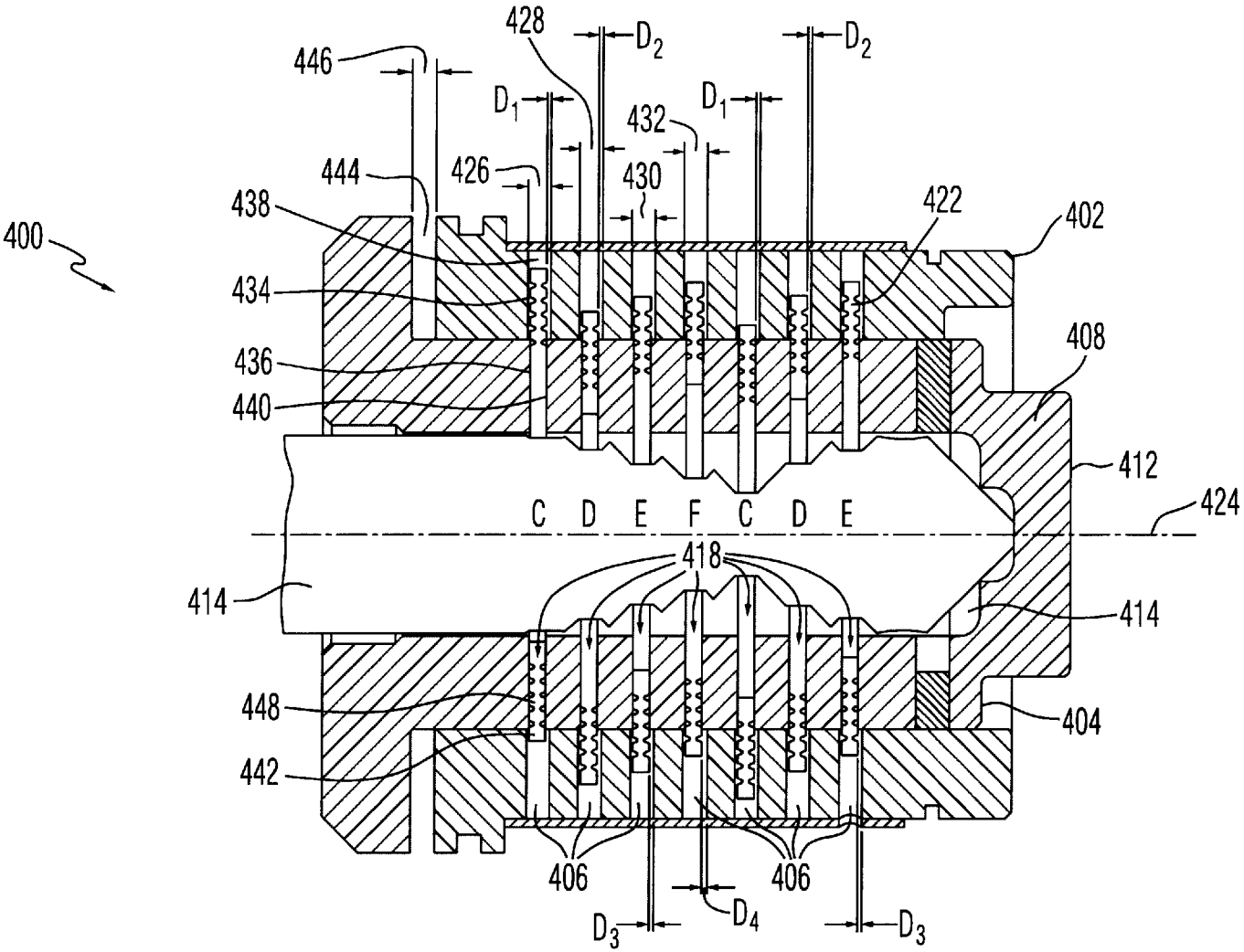
FIG. 22 is a cross-sectional view of a third embodiment of the present invention.

FIG. 22 shows a lock 400 that comprises a substantially cylindrical shell 402 that has a shell interior cavity 404. As shown, shell 400 has seven shell passageways 406 extending radially from the exterior of the shell 402 to the interior cavity 404. Plug 408 has seven plug passageways 418 extending radially from a keyway 414 across the plug 408. The plug passageways 418 are alignable with shell passageways 406 for inserting shearable tumblers 422.

Whereas the widths of the shell passageways in the previous embodiment were substantially equal to each other, the shell passageways 418 of lock 400 have different widths. The shell passageways 406 at axial locations C preferably have the smallest axial width 426, which is preferably larger than the axial width of the preformed tumblers 422 by a width $D_1$ of about 0.001 inches. The shell passageways 406 at axial locations D preferably have a larger axial width 428, which is larger than the axial width of the preformed tumblers 422 by a width $D_2$ of about 0.005 inches. The shell passageways 406 at axial locations E have a still larger axial width 430, which is preferably larger than the axial width of the preformed tumblers 422 by a width $D_3$ of about 0.009 inches. Finally, the shell passageway 406 at axial locations F preferably has the largest axial width 432, which is preferably larger than the axial width of the preformed tumblers 422 by a width $D_4$ of about 0.015 inches.

While the proximal wall 434 of the shell passageways 406 are generally aligned with the proximal wall 436 of the plug passageways 418, the distal wall 438 of the shell passageways 406 are disposed further toward the plug tail 412, or distally, than the distal walls 440 of the plug passageways 418. Thus, a gap of axial widths D1–D4 remains ahead of the shearable tumbler portions 442.

In the assembly of the lock 400, the plug 408 is inserted into the interior cavity 404 of the shell 402 along a center axis 424 such that the shell passageways 406 and plug passageways 418 are aligned creating the gap 444 to produce a shear distance 446 between the shell 402 and the plug collar 410 of the plug 408. The tumblers 422 are inserted in the aligned plug and passageways 406 and 418 as in the previous embodiment. The plug 408 is thereafter forced axially into the shell 402 over the shear distance 446, shearing tumblers 422 and closing the gap 444 between the shell 402 and plug collar 410. The shear distances required for shearing each of the tumblers 422 inserted in the shell and plug passageways 406 and 418 are different for the tumblers 422 located at different axial locations C–F. Thus, the plug must be moved by a distance greater than D1 to shear the tumblers 422 at locations C, by a distance greater than D2 to shear the tumblers at locations D, by a distance greater than D3 to shear the tumblers 422 at locations E, and by a distance greater than D4 to shear the tumbler 422 at location F. As a result, the two tumblers 422 at C are sheared first. Then the two tumblers 422 at locations D and then at locations E's are sheared, and finally the tumbler at location F is sheared. This configuration of the shell 402 thus reduces the force required for shearing of the tumblers 422, as less than all of the tumblers 422 are being sheared at anyone time, or at least the tumblers at different locations are in different stages of shearing at any point in time. The shearing of the tumblers 422 is thus staggered. The maximum force required to shear the tumblers 422 is thus 2/7 of the maximum force that would be needed if all of the tumblers 422 were sheared simultaneously.

The same effect can be achieved by providing equally sized shell passageways, but spaced unequally from each other. The disposal of the distal walls 438 of the shell passageways 406 at different distances from the tumblers 422 will ensure that less than all of the material that constitutes the shearable portions 442 of the tumblers 422 is sheared at one time, reducing the shearing force required to form the plug portions 448.

Figure 23:
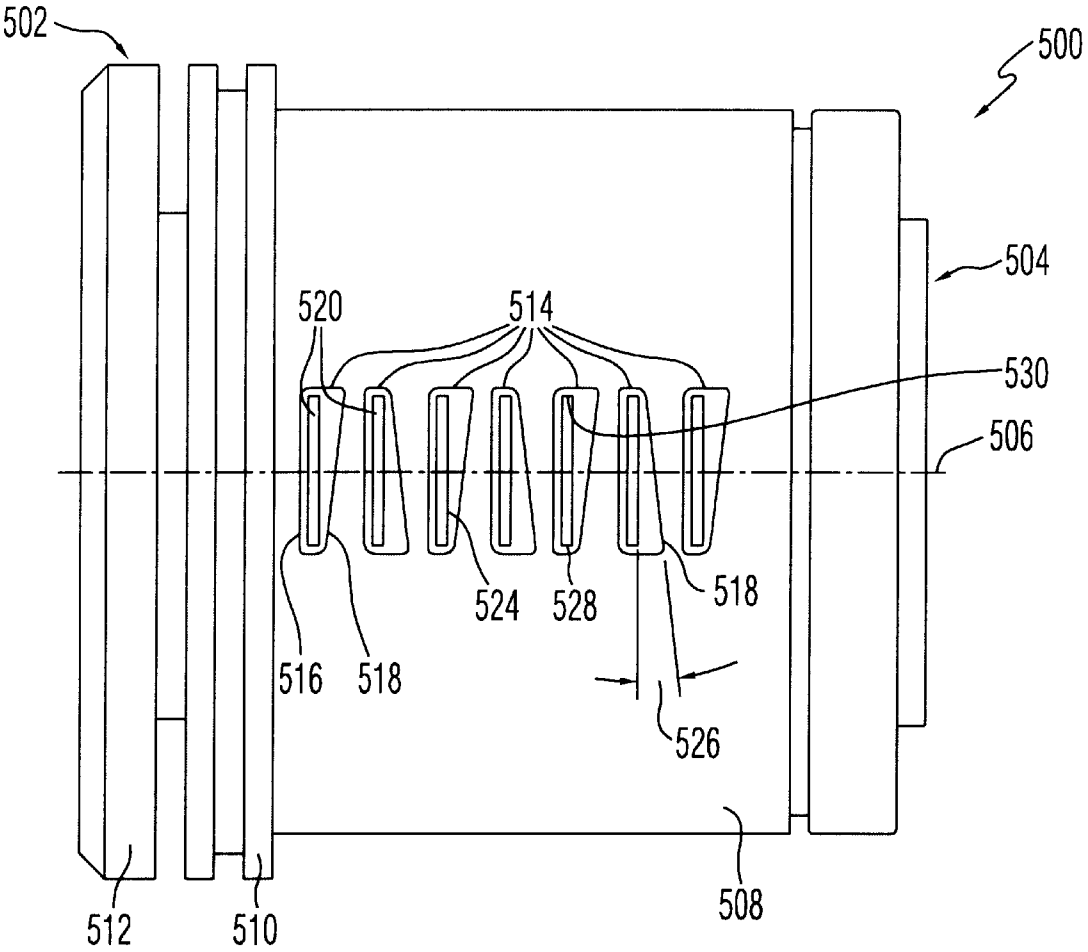
FIG. 23 is top view of a fourth embodiment of the present invention shown illustratively without a retention sleeve.
Figure 24:
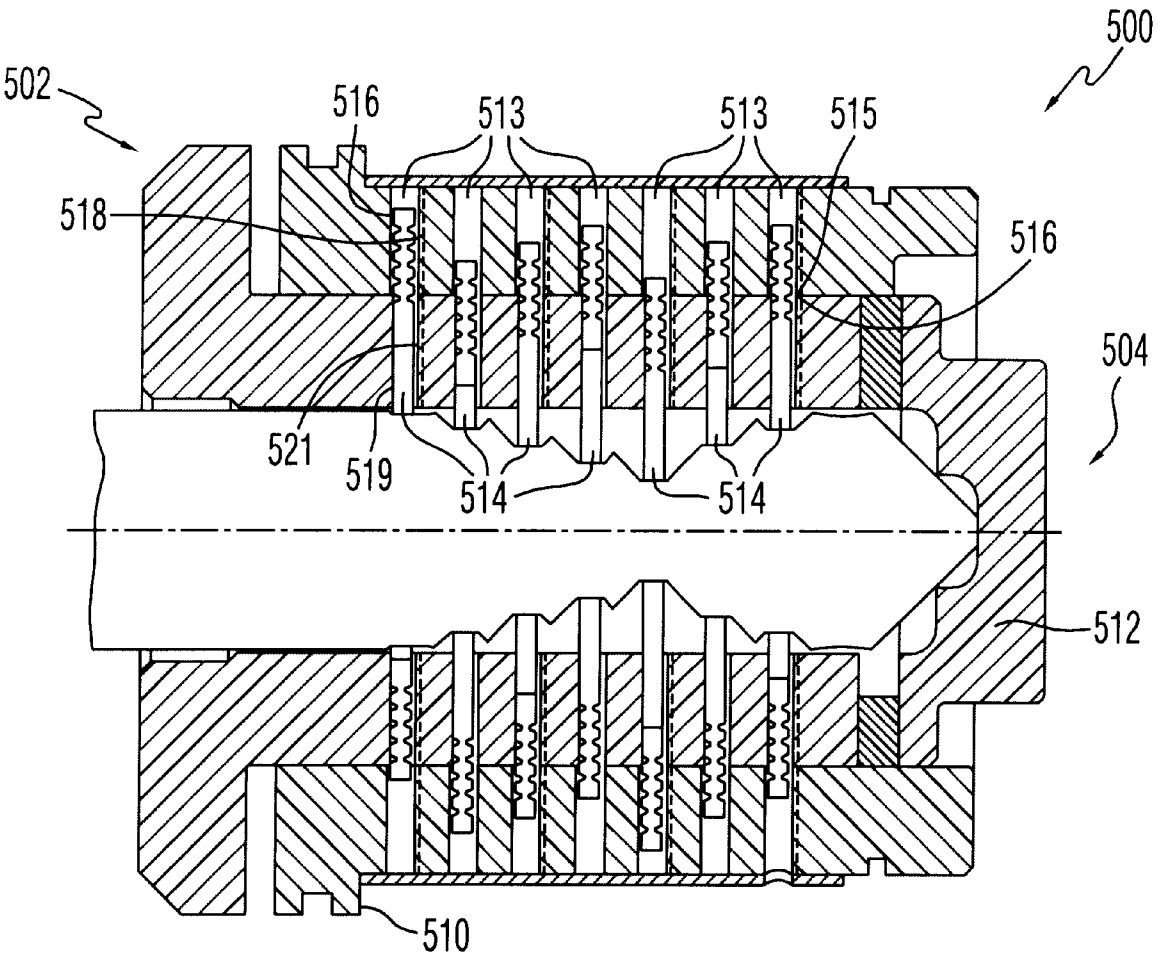
FIG. 24 is a cross-sectional view of the tumbler in FIG. 23 shown with a retention sleeve.

Another embodiment of the invention is shown in FIGS. 23 and 24. The retention sleeve has been removed for clarity. In FIG. 23, the lock 500 has a front portion 502, a back portion 504 and a center axis 506. Lock 500 further comprises a shell 510 and a plug 512 having shell and plug passageways 513 and 514, respectively, axially positioned in a series. Shell passageways 513 extend through the shell 510 forming shell shearing walls 515 and plug passageways 514 extend through the plug 512, forming shearing walls 516 at the interface therebetween. In addition, each shell passageway 513 has a shell front wall 516 located toward the front portion 502 of the lock 500 and a shell back wall 518 located toward the back portion 504 of the lock 500. Similarly, each plug passageway 514 has a plug front wall 519 located toward the front portion 502 of the lock 500 and a plug back wall 521 located toward the back portion 504 of the lock 500.

Tumblers 520 are inserted within the passageways 513 and 514. Each tumbler 520 has a front lateral side or shearing surface 522 facing the front portion 502 of the lock 500 and a back lateral side or shearing surface 524 facing the back portion 504. The front and back sides 522 and 524 define the shearing portion of the tumbler 520. The walls of the plug and shell passageways of the previous embodiments were shown as parallel with respect to each other and substantially perpendicular to the longitudinal axis of the lock. In contrast, the back walls 518 of the shell passageways 513 form a shearing angle 526 with a line perpendicular to the longitudinal axis 506 of the lock 500. Similarly, the back walls 521 of the plug passageways 514 form the same shearing angle 526 with a line perpendicular to the longitudinal axis 506. The shear angle 526 is preferably less than 20° and more preferably less than about 15°. Most preferably, the shear angle 526 is about 5°.

Each tumbler 520 has a first lateral end 528 and a second lateral end 530 where the first lateral end 528 is located closer to the back walls 518 and 521 of the shell and plug passageways 513 and 514 than the second lateral end 530.

The passageways 514 of the lock 500 are positioned such that when an axial shear force is applied to the plug 512 in a direction parallel to the center axis 506 from the back portion 504 to the front portion 502 of the lock 500, the front walls 516 and 519 gradually begin contacting the first lateral side 522 of the tumblers 520, and the tumblers 520 are pushed toward the back walls 518 and 521 as the tumblers 520 are sheared across the cross-section thereof from the first lateral end 528 to the second lateral end 530. The angled back walls 518 and 521 substantially secure the first lateral ends 528 in place and allow gradual movement of the tumblers 520 such that only the second lateral ends 530 are allowed to pivot toward the back walls 518 and 521. The shearing persists until the entire lateral surface of the tumbler 522 is sheared. Accordingly, shearing of the tumblers 522 occurs from the first lateral end 528 to the second lateral end 530 laterally across the tumblers 522. As the contact of the front walls 516 and 519 with the tumbler 520 is not the entire lateral surface of the tumblers 520 at any point in time, less shearing force is required to shear the tumblers 522 than shearing tumblers in an embodiment having parallel front and back walls of shell and plug passageways.

Additionally, about half of the back walls 518 and 521 are angled in a first lateral direction, and about the other half of the back walls 518 and 521 are angled in the opposite lateral direction. The net effect of the angled passageways 513 and 514 is that the back walls 518 and 521 tend to twist the plug 512 in one direction, increasing the force of the tumblers 522 against the back walls 518 and 521 that are oriented in the opposite direction. Accordingly, the lateral orientations of the back walls 518 and 521 of the passageways 513 and 514 are preferably staggered axially to prevent the front portion 502 of the plug 512 from being twisted one way while the back portion 504 is twisted the opposite way, thereby stabilizing the lock 500 during the shearing process.

Figure 26:
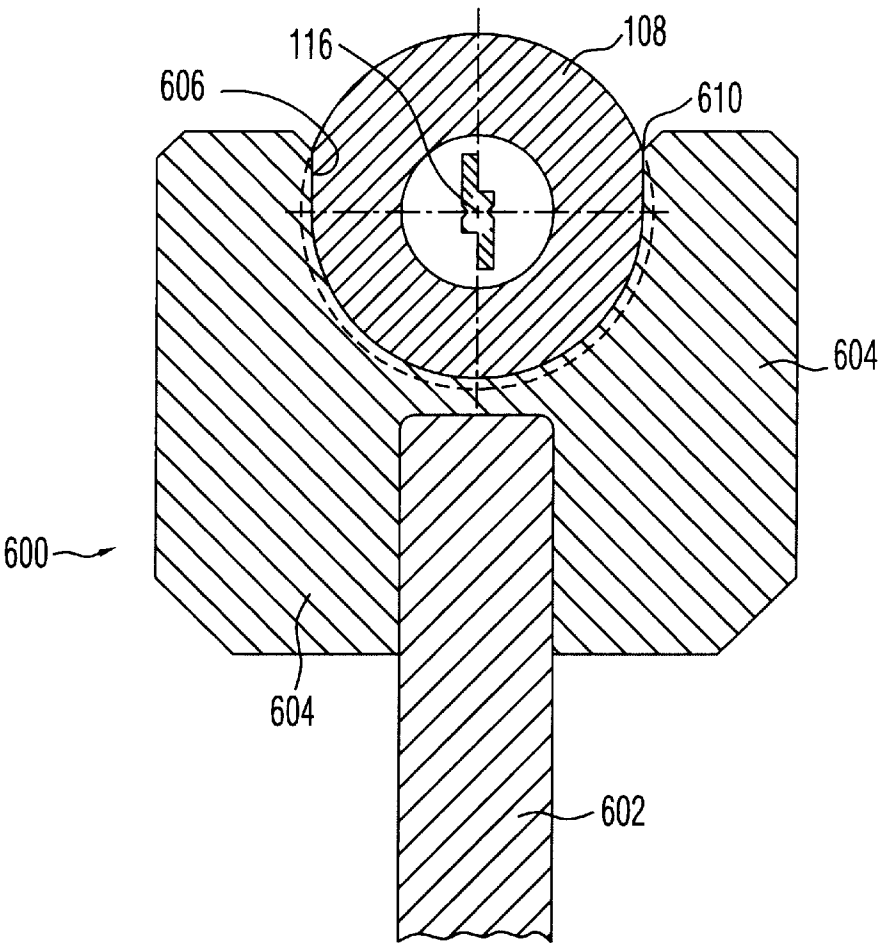
FIG. 26 is a cross-sectional view of the apparatus of FIG. 25 along plane 26—26.
Figure 25:
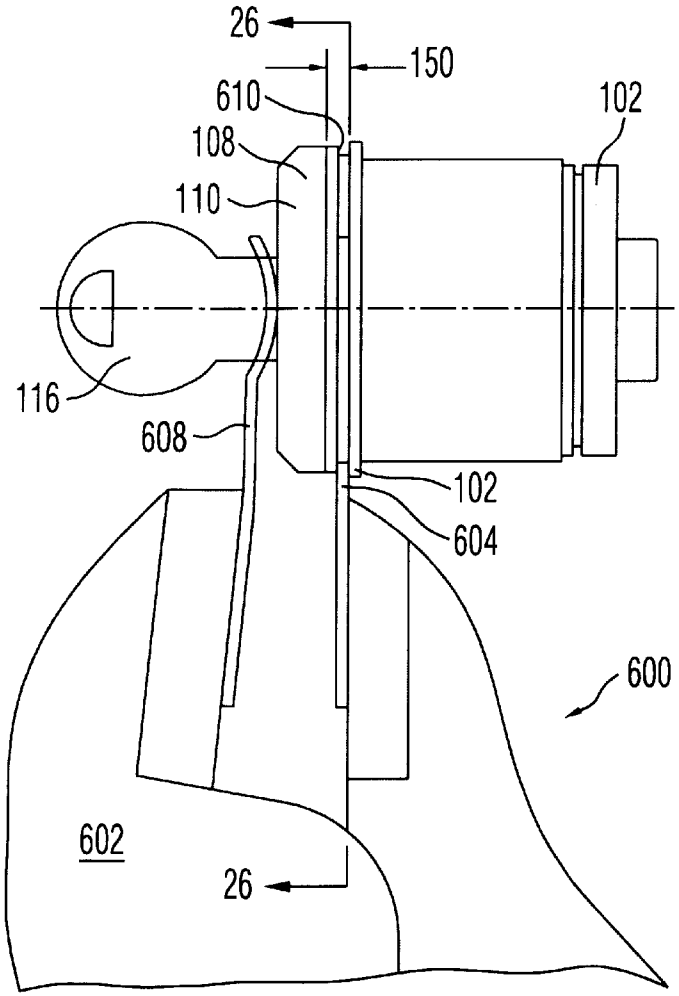
FIG. 25 is a side-elevational view of an apparatus for holding the lock assembly when shearing tumblers.

FIGS. 25 and 26 illustrate an apparatus that may be used for mounting the lock assembly in a loading position and for applying the shearing force required for shearing the tumblers. The shearing apparatus 600 includes a fixture 602, which may be a wrench, with a lock holder 604 having a substantially semicircular holder recess 606 for receiving the lock 100 and a plunger 608 connected to the fixture for pivotal movement with respect to the holder 604. Lock 100, in its loading position with its shell 102, plug 108, key 116 and unsheared tumblers 122 placed within the shell 102 and plug 108, is placeable in the holder recess 606 of the holder 604. Lock 100 is placed within the holder 604 by inserting the holder 604 into and abutting the walls of a circumferential groove 610 on the shell 102 such that the walls of the groove 610 abuts the holder recess 606 with the plunger 608 abutting the external surface of the plug collar 110.

To shear the tumblers 122, lock 100, including shell 102, plug 108, key 116 and tumblers 122, in the loading position with the shearing gap 150, is placed in the lock holder 604 with the shearing gap 150 between the circumferential groove 610 and the plug collar 110. A force is applied to the lock 100 by pivoting the plunger 608 toward the holder recess 606, and the plug collar 110 is forced axially toward the circumferential groove 610, effectively closing the gap 150 and shearing the tumblers 122. After the tumblers 122 are sheared, the plunger 608 is released and the lock 100, now fitted for key 116, is removed from the shearing apparatus 600 by sliding the holder 604 away from the groove 610.

EXAMPLE

The above described aspects of the lock constructed according to the present invention will now be described with reference to the following non-limiting examples. These examples are merely illustrative of one of the preferred embodiments of the present invention and are not to be construed as limiting the invention, the scope of which is defined by the appended claims. These examples illustrate several of the above described manners in which the total shear force required to shear the tumblers is minimized while maximizing the total rotative torque strength of the tumblers to maintain the level of security desired for the lock.

Table 1 is a tabulation of the test results using a lock having tumbler with arcuate grooves, as shown in FIGS. 5 and 6, stamped across the lateral surface of the tumblers and a substantially cylindrical plug. Table 2 is a tabulation of the test results using a lock having tumbler with substantially straight grooves, as shown in FIGS. 18 and 19, stamped across the lateral surface of the tumblers and a plug having a correspondingly straight or flattened surface across the openings of the plug passageways, as shown in FIGS. 20 and 21. Other common parameters included the shell having an inside diameter of 0.686 inches at the inner cavity and a plug having an outside diameter of 0.680 inches, creating a shell and plug shearing zone of 0.006 inches. The tested tumblers were made from hardened brass having a groove thickness of 0.004 inches. The plug and shells were made from zinc plated metals. The varied parameters, in addition to the shape of the grooves stamped on the tumblers included the outside thickness of the tumblers 313 as shown in FIG. 19, shear contact angle 526 between the shearing surface of the back walls 518 and 521 and the back tumbler side 524, as shown in FIG. 23. Tumblers having outside thickness of 0.012 inches and 0.005 inches were tested. Shearing angle 526 of 0°, 4° or 8° as shown in FIG. were also tested.

The tests measured the required shearing force to shear the tumblers to a configuration in which the lock is operable with a particular key. These tests also measured the torque strength of the operable portions of the tumblers against the passageways, corresponding to the amount of torque the tumbler can resist when the plug is forced rotationally in the shell with the tumblers in the locked position. As stated earlier, it is desirable to maximize the rotative torque strength of the tumblers while minimizing the axial shearing force required for manufacturing a lock that is easily fitted with any insertable key.

TABLE 1

Arcuate/Curved Grooves

| Example | Shear Angle (°) angle of contact between the passageways and the tumblers (as shown in FIG. 23) | Tumbler Thickness (in) | Shear Force (lbs) | Torque (lb-in) Strength |
|---|---|---|---|---|
| A1 | 0 | 0.005 | 200 | 31.75 |
| A2 | 4 | 0.005 | 70.6 | 31.75 |
| A3 | 4 | 0.012 | 100 | 51.75 |
| A4 | 8 | 0.005 | 41 | 31.75 |
| A5 | 8 | 0.012 | 71 | 51.75 |

TABLE 2

Straight Grooves

| Example | Shear Angle (°) angle of contact between the passageways and the tumblers (as shown in FIG. 23) | Tumbler Thickness (in) | Shear Force (lbs) | Torque (lb-in) Strength |
|---|---|---|---|---|
| S1 | 0 | 0.005 | 230 | 45.25 |
| S2 | 4 | 0.005 | 67.8 | 45.25 |
| S3 | 4 | 0.012 | 100 | 47.5 |
| S4 | 8 | 0.005 | 54.5 | 45.25 |
| S5 | 8 | 0.012 | 91 | 47.5 |

These tests demonstrated generally that a tumbler having a thickness of 0.012 in. requires greater total shear force than a tumbler having a thickness of 0.005 in. The maximum torque strength of tumblers, or the maximum rotative torque applied between the shell and plug that the tumblers were able to withstand before failing, varied more significantly between the two thicknesses for tumblers having arcuate grooves than for tumblers having straight grooves. A lock having arcuately grooved tumblers and angled contact surfaces between the passageways and the tumblers required less total shear force to shear the tumblers than a lock without angled contact surfaces between the passageways and the tumblers. By reducing the contact surface between the passageways and the tumblers at any point in time during shearing, the total shear force required for shearing is significantly reduced. Similarly, a lock having straight grooved tumblers and angled contact surfaces require 43% of the total shear force required to shear the tumblers than a lock without angled contact surfaces. Most notably, a lock having 0.005 in. thick tumblers and an 8° shear contact angle between the passageways and the tumblers required only 24% of the shear force than a lock having the same tumblers but without the angled shear contact surfaces, while maintaining the same tumbler torque strength.

It will be appreciated that those skilled in the art may devise numerous modifications and embodiments. It is intended that the following claims cover all such modifications and embodiments as fall within the true spirit and scope of the present invention.

What is claimed is:

1. A lock, having a longitudinal axis and comprising:

(a) a shell having an interior cavity;

(b) a plug received in the interior cavity rotatable therein and defining a keyway configured to receive a preselected key;

(c) at least one spring disposed within the plug; and (d) a plurality of tumblers, each having:

(i) a plug portion disposed at one of a plurality of first axial locations along said axis and within the plug wherein the plug portion is resiliently biased by the at least one spring radially outwardly toward a locked radial position and associated with the keyway such that said preselected key inserted in the keyway locates the plug portion in an unlocked radial position; and (ii) a shell portion disposed at one of a plurality of second axial locations along said axis and within the shell wherein the second axial locations are axially spaced from the first axial locations.

2. The lock of claim 1, wherein said shell and plug portions of each one of the tumblers are portions of a single tumbler sheared from each other at a location between the plug and the shell such that:

(a) when the plug portion is in said locked radial position, the plug portion is disposed in an interface position with the shell to restrict relative rotation of the plug within the shell; and (b) when the plug portion is in the unlocked radial position, the plug portion is disposed in a non-interface position with the shell to permit the rotation of the plug within the shell.

3. The lock of claim 2, wherein:

(a) a plurality of said tumbler plug portions are disposed at axially spaced locations within said plug and biased outwardly from the plug; and (b) the shell further comprises an external surface and a plurality of passageways extending radially from said interior cavity toward the external surface for receiving a plurality of said tumbler shell portions.

4. The lock of claim 3, wherein the shell further comprises at least one first locking channel extending from said interior cavity toward said external surface for engaging said plug portion of the tumbler in said locked position.

5. The lock of claim 1, wherein said shell portion is out of alignment with said plug portion.

6. A lock, comprising:

(a) a plug defining a keyway for receiving a preselected key;

(b) a plurality of tumblers receivable in the plug for radial movement therein;

(c) a shell having an interior cavity and an exterior surface and defining a plurality of passageways radially connecting the interior cavity to the exterior surface for receiving the tumblers and further defining a locking space extending from said interior cavity toward said exterior surface to receive the tumblers in locking association therein for preventing rotation of the plug; and (d) at least one spring disposed within the plug for biasing the tumblers radially outwardly from the plug;

wherein the plug is rotationally and axially receivable within the interior cavity about a rotational axis, and the tumblers are receivable through the passageways for insertion into the plug in a loading position and arc out of alignment with the locking space wherein said plug and interior cavity of said shell define a shearing zone such that when the plug and shell are biased axially with respect to each other with a preselected axial shearing force, the tumblers are sheared to an operative position having a plug portion and a shell portion, the plug portion of said tumblers in the operative position permitting rotation of the plug within the shell in an unlocked position and interfacing with the shell to restrict relative rotation of the plug in a locked position, wherein the at least one spring is disposed for biasing the tumblers toward the locked position.

7. The lock of claim 6, wherein each tumbler has a plurality of weakened zones having a weaker strength relative to the rest of the tumbler with one of said weaker zones disposed at said shearing zone in said loading position when said preselected key is inserted in said keyway.

8. The lock of claim 7, wherein:

(a) the tumblers further comprise opposed sides connected by edges such that said weakened zone extends laterally across the sides in a predetermined shape; and (b) said plug has a shearing edge associated with said plug portion of said tumblers and defining an outer contour having generally said predetermined shape for supporting the plug portion upon the application of said axial shearing force.

9. The lock of claim 8, wherein said predetermined shape is arcuate.

10. The lock of claim 8, wherein said predetermined shape is substantially straight.

11. The lock of claim 6, wherein the tumblers are movable within the plug in different radial directions with respect to the plug.

12. The lock of claim 6, wherein said shell further defines a groove extending circumferentially about the exterior thereof for engaging a tool for applying said preselected force.

13. The lock of claim 6, further comprising a retention sleeve mountable around the exterior of the shell in a position covering the passageways for retaining the tumblers therein.

14. The lock of claim 13, wherein the retention sleeve defines sleeve slots alignable with the passageways for loading the tumblers into the plug therethrough.

15. The lock of claim 14, wherein:

(a) first and second of the shell passageways arc axially spaced along said rotational axis; and (b) first and second sleeve slots are angularly displaced about the rotational axis by an angle such that the sleeve is positionable on the shell in:

(i) a first loading position in which the first sleeve slots are radially aligned with the first shell passageways with the second sleeve slots out of alignment with the second shell passageways, and (ii) a second loading position in which the second sleeve slots are radially aligned with the second shell passageways with the first sleeve slots out of alignment with the first shell passageways, each sleeve slot and corresponding shell passageway when aligned permitting the insertion therein of one of said tumblers.

16. The lock of claim 6, wherein said locking space is angularly displaced about said rotational axis from said plurality of shell passageways.

17. The lock of claim 16, wherein said locking space is angularly displaced about said rotational axis from said plurality of shell passageways by an angle of about 90°.

18. The lock of claim 6, wherein said locking space comprises a locking channel extending substantially in parallel to said rotational axis.

19. The lock of claim 6, wherein said locking space is out of alignment with said shell portions.

20. A lock having a longitudinal axis, comprising:

(a) a shell including an interior cavity and a plurality of shell passageways having opposed lateral shell walls extending laterally of said longitudinal axis;

(b) a plug defining a keyway and being axially slidably receivable in the interior cavity and defining a plurality of plug passageways having opposed lateral plug walls radially aligned with said shell passageways;

(c) a tumbler disposed in each of said aligned shell and plug passageways and associated with the keyway such that a preselected key inserted in the keyway locates the tumblers in an unlocked radial position, each tumbler having:

(i) a plug portion with a first shearing surface facing one of the opposed lateral shell and plug walls, the first shearing surface of all of the plug portions collectively comprising collective first shearing surfaces, and (ii) a shell portion with a second shearing surface facing another opposed shell and plug walls, the second shearing surface of all of the shell portions collectively comprising collective second shearing surfaces; and (d) the shell portions of said tumblers being attached to the plug portions in a pre-formed configuration and shearable from the plug portions of the tumblers to a formed configuration upon axially biasing one wall of the plug toward the opposite wall of the shell with a predetermined axial shearing force; and (e) wherein the opposed walls of the shell and plug passageways are in association with the tumblers for progressively contacting the total collective first or second surfaces during the application of said preselected axial shearing force for shearing the tumblers.

21. The lock of claim 20, wherein the wall of each plug and shell passageways facing in a direction opposite the direction of the axial shearing force applied to said first collective shearing surfaces is oriented at an acute shearing angle with respect to the opposite wall of each plug and shell passageway.

22. The lock of claim 21, wherein the acute shearing angle is between about 2° and 15°.

23. The lock of claim 20, wherein the wall of each plug and shell passageways facing in a direction opposite the direction of the axial shearing force applied to said first collective shearing surfaces is oriented at an acute shearing angle with respect to the tumblers.

24. The lock combination of claim 20, wherein the opposed lateral shell walls of a first shell passageway are spaced axially from each other by a first distance and the opposed shell walls of a second shell passageway are spaced from each other by a second distance different than the first distance.

25. The lock combination of claim 24, wherein the plug portions of said tumblers in said formed configuration are disposed in:

(a) an unlocked position permitting rotation of the plug within the shell; and (b) a locked position interfacing with the shell to restrict relative rotation of the plug within the shell.

* * * * *